US006113149A

United States Patent [19]

Dukatz

[11] Patent Number: 6,113,149

[45] Date of Patent: Sep. 5, 2000

[54] PSEUDO THREE-DIMENSIONAL IMAGE DISPLAY AND METHOD OF MANUFACTURING INCLUDING TACTILE SURFACE TEXTURE

[75] Inventor: Eugene M. Dukatz, West Bend, Wis.

[73] Assignee: Serigraph, Inc., West Bend, Wis.

[21] Appl. No.: 08/994,257

[22] Filed: Dec. 19, 1997

[51] Int. Cl.[7] ..... B42D 15/00

[52] U.S. Cl. ..... 283/91; 283/109

[58] Field of Search ..... 283/107, 109, 283/111, 91, 86; 428/40.1, 40.9, 41.7, 42.1, 201, 203, 204, 205, 913.5, 172, 207, 213; 156/220; 427/258, 208

[56] References Cited

U.S. PATENT DOCUMENTS

| | | | |
|---|---|---|---|
| 3,912,842 | 10/1975 | Swartz | 428/172 |
| 4,933,218 | 6/1990 | Longobardi | 428/38 |
| 5,082,703 | 1/1992 | Longobardi | 428/38 |
| 5,106,126 | 4/1992 | Longobardi et al. | 283/94 |
| 5,223,357 | 6/1993 | Lovison | 430/1 |
| 5,411,296 | 5/1995 | Mallik | 283/86 |
| 5,582,103 | 12/1996 | Tonaka et al. | 283/91 X |
| 5,714,213 | 2/1998 | Antes et al. | 428/30 |
| 5,762,379 | 6/1998 | Salmon et al. | 382/91 |
| 5,856,048 | 1/1999 | Tahara et al. | 283/86 X |

*Primary Examiner*—Willmon Fridie, Jr.
*Attorney, Agent, or Firm*—Arter & Hadden LLP; David G. Alexander

[57] ABSTRACT

A reflective layer is formed on a front surface of a cardboard or other base sheet. An at least partially transparent printed image is formed on the reflective layer. A first textured pattern which provides the illusion of depth is formed on at least part of the printed image, and a protective transparent layer is formed over the textured pattern and image. A second textured pattern which provides a tactile texture feeling is formed on at least part of the transparent layer. The textured patterns can be formed as thick ink layers, or alternatively by embossing to provide convex or concave shapes. An additional image and protective transparent layer can be formed on a back surface of the base sheet.

47 Claims, 3 Drawing Sheets

PSEUDO THREE-DIMENSIONAL IMAGE DISPLAY AND METHOD OF MANUFACTURING INCLUDING TACTILE SURFACE TEXTURE

CROSS-REFERENCE TO RELATED APPLICATION

This application discloses subject matter which is related to that of copending U.S. patent application Ser. No. 08/601,084, entitled "PRINTED ARTICLE", filed Feb. 14, 1996; and Ser. No. 08/794,331, entitled "PSEUDO-THREE DIMENSIONAL IMAGE DISPLAY AND METHOD OF MANUFACTURING INCLUDING REFLECTIVE MONOCHROME OR HOLOGRAPHIC ROLL LEAFING", both by Joseph P. Salmon et al.

BACKGROUND OF THE INVENTION

1. Field of the Invention

The present invention relates to a method of manufacturing a printed article having a pseudo three-dimensional image display including tactile surface texture. Examples of such articles are trading cards, greeting cards, signs, posters, labels, decals, book covers, decorative panels, and name plates.

2. Description of the Related Art

Three-dimensional images are highly desirable due to the added visual impact provided by depth. Various methodologies have been proposed in the prior art to provide three-dimensional images using two-dimensional media.

One proposal involves printing two offset images in different colors on an opaque or transparent sheet, and viewing the images using special glasses having right and left lenses which correspond to the different image colors respectively. Where the sheet is transparent, the offset images can be projected onto a screen to produce a three-dimensional slide show or movie. Holographic technology can also be used to produce an image on a flat sheet which appears three-dimensional when illuminated and viewed at the proper angles.

However, these methodologies have not been commercially popular for various reasons. The offset image method is undesirable in that special glasses are required to view the image. Holograms are difficult and expensive to produce.

For this reason, processes have been proposed to produce pseudo three-dimensional images which are basically two-dimensional, but have some quality that simulates depth. One such process is conventional embossing, which forms a raised pattern on a business card or the like by physically deforming part of the card upwardly.

Conventional embossing, although practical in some applications, suffers from the drawback that an expensive press is necessary to perform the operation, and a die bearing the desired embossed pattern must be made for each application. The cost becomes prohibitive for large image displays such as signs, and the process is not usable at all for sheets made of materials such as glass which are not readily deformable at temperatures below their considerably high melting points.

U.S. Pat. No. 4,933,218 to L. Longobardi discloses a method for producing a sign having an embossed appearance which does not require physical deformation. The method involves printing an extraordinarily thick ink pattern on the rear surface of a transparent sheet, and printing a transparent ink image in areas not occupied by the thick ink pattern. A reflective layer is then formed over the ink pattern and image.

The sign is viewed through the transparent sheet such that light is reflected back from the reflective layer through the ink pattern and image. The ink image has a normal two-dimensional appearance when thusly viewed. The thick ink pattern is formed around edge and other desired portions of the image to produce a pseudo three-dimensional effect which simulates embossing. An alternative is to produce an etched effect using a textured ink pattern rather than a thick ink pattern.

A variation of this method is disclosed in U.S. Pat. No. 5,082,703, also to Longobardi, in which the reflective sheet is replaced by a reflective stratum which can be sprayed onto the rear surface of the sheet.

U.S. Pat. No. 5,106,126, to L. Longobardi and D. Lovison, discloses a colored image consisting of a large number of small dots, in combination with a stratum of opaque white ink deposited between a reflective layer and preselected portions of the image to block passage of visible light from the preselected portions to the reflective layer. U.S. Pat. No. 5,223,357, to D. Lovison, discloses an arrangement similar to that of U.S. Pat. No. 5,106,126 in which the reflective layer is replaced by a holographic layer to present a variable color cast to the image.

A problem which exists with the Longobardi and Lovison proposals are that they require a transparent sheet of glass, plastic, etc., with the image being formed on a rear surface of the sheet which faces away from the viewer. These methods are not readily applicable to producing printed articles such as trading cards which have opaque, in this case cardboard, base sheets. More specifically, a second sheet on which the rear surface image is formed must be laminated to the rear surface of the transparent sheet.

In addition, the ink pattern and ink image are located underneath the front surface of the sheet and cannot be felt by a person handing the article. For this reason, the prior art arrangements cannot produce an article which has a desirable tactile surface texture that can be felt by touch.

Known lamination methods present certain problems. Not only does lamination add to the cost of producing two-sided objects, but misregistration (misalignment of the images on opposite sides of the sign, poster or card relative to one another) is often introduced during the lamination process. Through the structure and method of the present invention, this registration problem is greatly reduced if not eliminated.

A need therefore exists in the art for a method of producing a printed article having a pseudo three-dimensional image which can be advantageously applied to manufacturing two-sided trading cards and the like which have opaque base sheets.

SUMMARY OF THE INVENTION

It is an object of the present invention to provide a method for producing a printed or similarly produced article, which overcomes the drawbacks of the prior art, and enables a pseudo three-dimensional visual image display to be formed on a surface of a base sheet which can be opaque, reflective or transparent, and has a tactile textured surface feeling.

In accordance with the present invention, a reflective layer is formed on a front surface of a cardboard or other base sheet. An at least partially transparent printed image is formed on the reflective layer. A first textured pattern which provides the illusion of depth is formed on at least part of the printed image, and a protective transparent layer is formed over the textured pattern and image. A second textured pattern which provides a tactile texture feeling to the touch is formed on at least part of the transparent layer. The textured patterns can be formed as thick ink layers, or alternatively by embossing to provide convex or concave shapes. An additional image and protective transparent layer can be formed on a back surface of the base sheet.

Articles produced in accordance with the present invention are superior to those produced by presently known production methods such as described above. For example, a two-sided article, such as a trading card, poster, decal or sign, may be produced by printing an image (such as player statistics in a sports trading card) on the side of the sheet opposite that which supports the textured pattern. This eliminates the need to laminate two separately printed articles to one another, the method presently used to produce two-sided cards.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
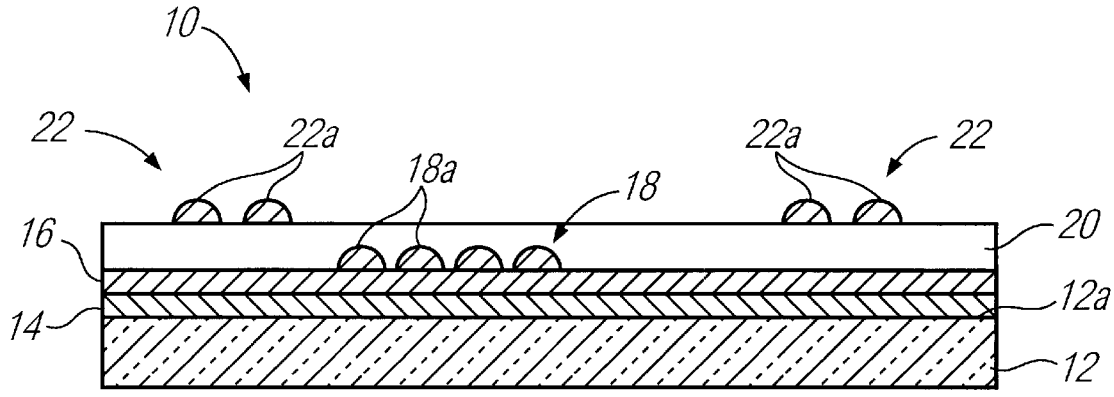
FIG. 1 is a cross-sectional view illustrating a pseudo three-dimensional image display formed on a printed article according to the present invention.

As illustrated in FIG. 1, a printed article 10 having a visual image display is manufactured in accordance with a method of the present invention. The article 10 includes a substrate or base sheet 12 which can be opaque or transparent, flexible or rigid.

An opaque sheet 12 can be formed of paper, cardboard, plastic, metal, or any other suitable material. An opaque sheet is appropriate for producing trading cards, greeting cards, signs, posters, labels, book covers, decorative panels, name plates, and the like. Alternatively, the sheet 12 can be replaced by an object having a flat surface, such as the side of a building.

A transparent sheet 12 can be formed of plastic, glass, or any other suitable material. A transparent sheet is appropriate for producing decals and the like, and can also be used for producing other items as indicated above in combination with a rear surface reflective layer and protective cover as will be described in detail below.

In a preferred embodiment of the invention, the base sheet 12 is formed of white styrene. A preferred thickness is 0.15", although the thickness can vary from approximately 0.005" to 0.250". For applications where greater flexibility is required, such as decals, the base sheet can be relatively thin or composed of a flexible plastic material. Conversely, thicker stock and rigid plastic may be used in applications where rigidity is required, such as free standing displays.

The sheet 12 has a front surface 12*a* which is typically flat, although the invention is not so limited. A reflective layer 14 is formed over the entire front surface 12*a*, or alternatively over only a selected portion or portions of the front surface 12*a*. The reflective layer 14 can be substantially opaque or at least partially transparent or translucent.

The reflective layer 14 is preferably formed of chrome polyester which is thermally laminated onto the base sheet 12 and has a thickness of 0.002". However, the thickness of the layer 14 can vary within the range of approximately 0.0001" to 0.020". Pressure sensitive chromes (cold lamination) and/or chrome foil beads can also be used.

The layer 14 can be clear or have any color. Alternative materials for the layer 14 include, but are not limited to, diffraction film, holographic foil or roll leafing, or any metallized material. In an embodiment in which the base sheet 12 is made of card stock having a shiny white or other colored front surface 12*a*, the reflective layer 14 can be constituted by the shiny surface.

The next step of the present process is to form an image 16 over all or a portion of the reflective layer 14. The image 16 can have any desired form, for example, the front of a sports trading card. A preferred method of forming the image 16 is offset printing with a white base layer and a four-color image over the base layer. The printed image 16 can be formed of substantially opaque or at least partially transparent inks. Alternative methods of forming the printed image include silk screening, flexography, gravure, etc.

A first textured pattern 18 is then formed on the printed image 16 which includes protrusions 18*a* in the form of lines, circular bumps, or any other suitable design. The textured pattern 18 can be formed over the entire printed image 16 or over only a portion thereof.

The pattern 18 is preferably formed by screen printing glossy ultraviolet curable ink, although alternative processes including flexography, offset printing, gravure, or physical embossing can be used. The ink used can be clear or have any color. It can also be substantially opaque or at least partially transparent.

The thickness or height of the textured pattern 18 is preferably approximately 0.0001" to 0.0015", and is selected in accordance with a particular application. It is further within the scope of the invention to have the textured pattern 18 thicker (higher) in some areas than in others. If a thickness greater than that which can be produced with a single silk screened layer is desired, then multiple layers may be applied one on top of the another until the desired thickness is attained.

The next step of the present method is to form a protective transparent layer 20 over the textured pattern 18 and any exposed portions of the underlying layers. The transparent layer 20 is preferably formed of clear polyester by thermal lamination, although alternative processes include extrusion, mounting, printing and coating using any clear plastic or ink. The transparent layer 20 can also be formed of a pressure sensitive sheet using cold lamination. The thickness of the transparent layer 20 is approximately 0.0015" to 0.250".

The final step of the process as illustrated in FIG. 1 is to form a second textured layer 22 over all or a portion of the surface of the transparent layer 20. The textured layer 22 includes protrusions 22a in the form of lines, circular bumps, or any other suitable design in a manner similar to the first textured layer 18. The layer 22 is preferably formed using screen printing with glossy ultraviolet curable ink, although alternative processes can be used. The ink can be clear or have any color. It can also be substantially opaque or at least partially transparent.

The first textured pattern 18 is provided to produce an illusion of depth, and thereby a pseudo-three dimensional image. Light incident on the article 10 from above as viewed in FIG. 1 is reflected off the glossy textured pattern 18 back through the transparent layer 20 to a viewer such that the pattern 18 appears to be in a third dimension which is different from the printed image 16. Light reflected back from the shiny reflective layer 14 also appears to be in a different, third dimension from the printed image 16.

The illusion is enhanced by making the textured pattern 18 at least partially transparent, whereby light is reflected from one or more of the underlying layers back through the pattern 18 as well as from the surface of the pattern 18. If the pattern 18 is formed over an opaque portion of the printed image 16, light will be reflected back to the viewer from the printed image 16 through the pattern 18 which diffracts or diverges the light. If the textured pattern 18 is formed over a transparent portion of the printed image 16, light will be reflected back from the reflective layer 14 through the printed image 16 and the pattern 18. In either of these latter cases, any color which is present in the textured pattern 18, printed image 16 and/or reflective layer 14 will be present in the light which is reflected back to the viewer.

The second textured pattern 22 is provided to provide a desirable tactile textured feeling to the touch which simulates embossing. The second textured pattern 22 is especially desirable in border areas, but can be provided anywhere on the surface of the transparent layer 20 or over the entire surface of the transparent layer 20. This layer also reflects light from its own plane which dramatically adds to the dimensional effect.

FIG. 1 illustrates an embodiment of the invention in which an image is formed on a single surface of a base sheet. It is further within the scope of the invention to provide a printed article image display with images on both sides of a sheet, for example a two-sided sports trading card as will be described below. This is accomplished, as illustrated in FIG. 2, by forming another printed image 24 on a rear or back surfaced 12*b* of the base sheet 12.

The image 24 is preferably formed by four-color offset printing with or without an underlying white ink layer in a manner similar to the printed image 16, although the image 24 can be formed using any suitable process. Further illustrated in FIG. 2 is an optional protective transparent layer 26 which typically will be essentially similar to the transparent layer 20.

Figure 2:
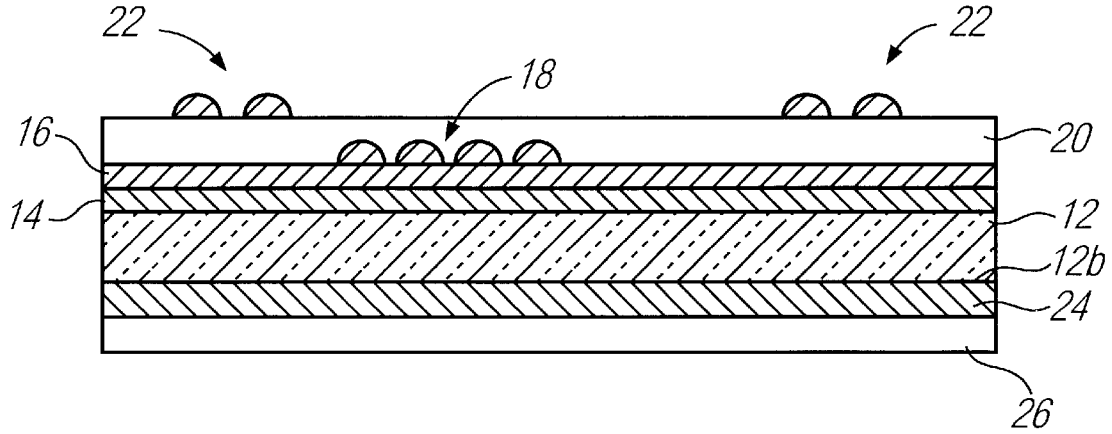
FIGS. 2 to 5 are cross-sectional views illustrating various modifications to the image display of FIG. 1 within the scope of the invention.
Figure 3:
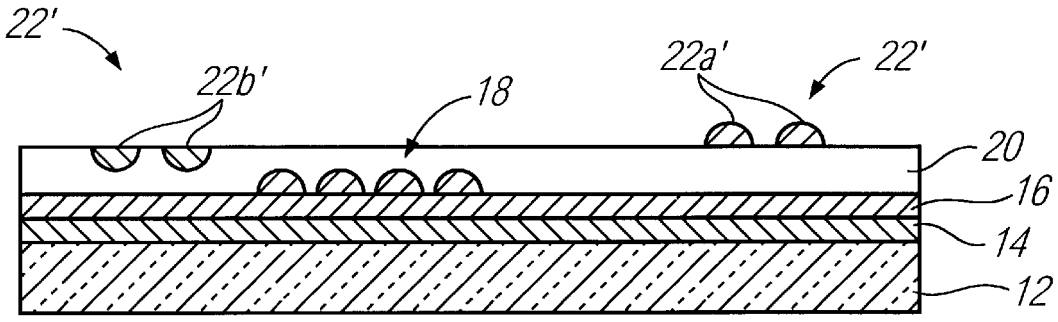

A number of variations on the embodiment of FIGS. 1 and 2 are contemplated within the scope of the present invention. Whereas the second textured pattern 22 is formed of ink and has a raised texture, a second textured pattern can be formed by, for example, embossing so as to have a recessed texture. As viewed in FIG. 3, a textured pattern 22' includes convex protrusions 22*a*' in the same manner as in FIG. 1. The pattern 22' further includes concave depressions 22*b*'. Although both protrusions 22*a*' and depressions 22*b*' are shown in FIG. 3, it is within the scope of the invention to form only the depressions 22*b*' in the transparent layer 20.

Figure 4:
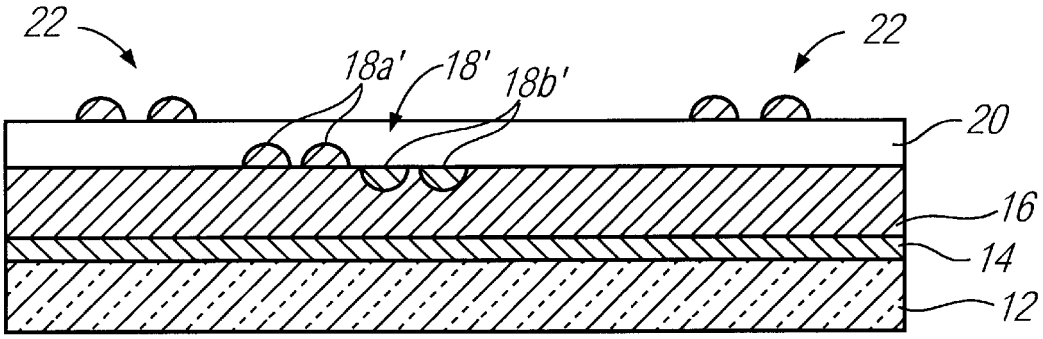

FIG. 4 illustrates another embodiment of the invention in which a first textured layer 18' includes protrusions 18*a*' and depressions 18*b*'. As with the embodiment of FIG. 3, it is within the scope of the invention to form only the depressions by, for example, embossing.

Figure 5:
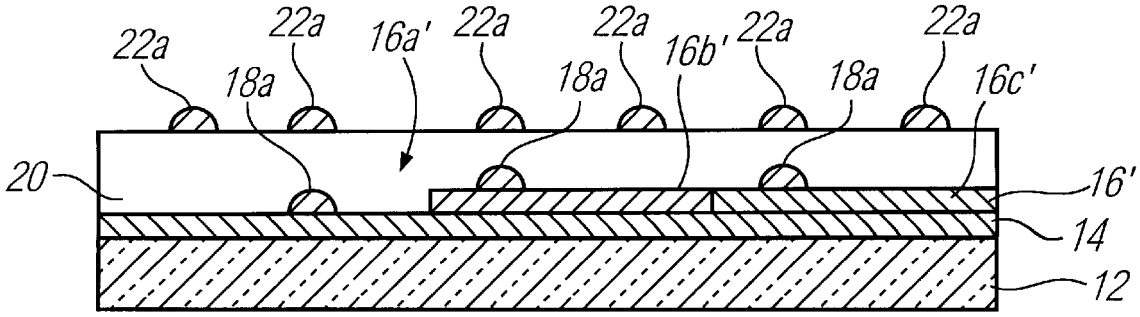

FIG. 5 illustrates several additional variations on the basic embodiment of FIGS. 1 and 2. It will be understood that although FIGS. 3 to 5 do not explicitly illustrate the printed layer 24 and transparent layer 26 of FIG. 2, these layers can be included in any embodiment of the invention.

In FIG. 5, a printed image 16' is formed over only a portion of the reflective layer 14, and is omitted in an area 16*a*'. The printed image 16' includes a substantially opaque portion or area 16*b*' and an at least partially transparent or translucent portion or area 16*c*'.

Protrusions 18*a* of the first textured layer 18 and protrusions 22*a* of the second textured layer 22 are illustrated as being formed over all three of these areas, although it is within the scope of the invention to selectively form the protrusions 18*a* and/or 22*a* over only one or two of these areas in any desired combination. Protrusions 22*a* can also be formed over all or selected protrusions 18*a* as illustrated. In this manner, the second textured layer 22 can be formed over all or selected portions of the first textured layer 18 to provide a combined depth and tactile textured feeling effect.

Assuming that the protrusions 18*a* are at least partially transparent, in the area 16*a*' light incident on the display is reflected back to a viewer from the reflective layer 14 through the protrusions 18*a*. In the area 16*b*', light is reflected back from the printed image 16' through the protrusions 18*a*, whereas in the area 16*c*' light is reflected back from the reflective layer 14 through the printed image 16' and the protrusions 18*a*. If the protrusions 22*a* (or alternatively depressions 22*b*' as illustrated in FIG. 4) are also at least partially transparent, light will be reflected back through these elements also.

Figure 6:
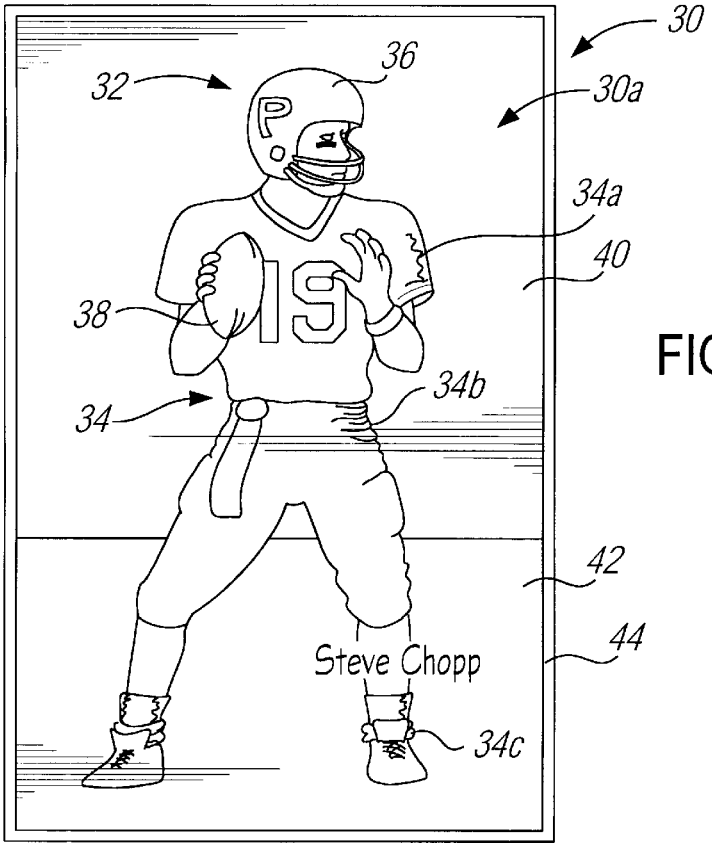
FIG. 6 is a front view of a trading card having an image display according to the invention.
Figure 7:
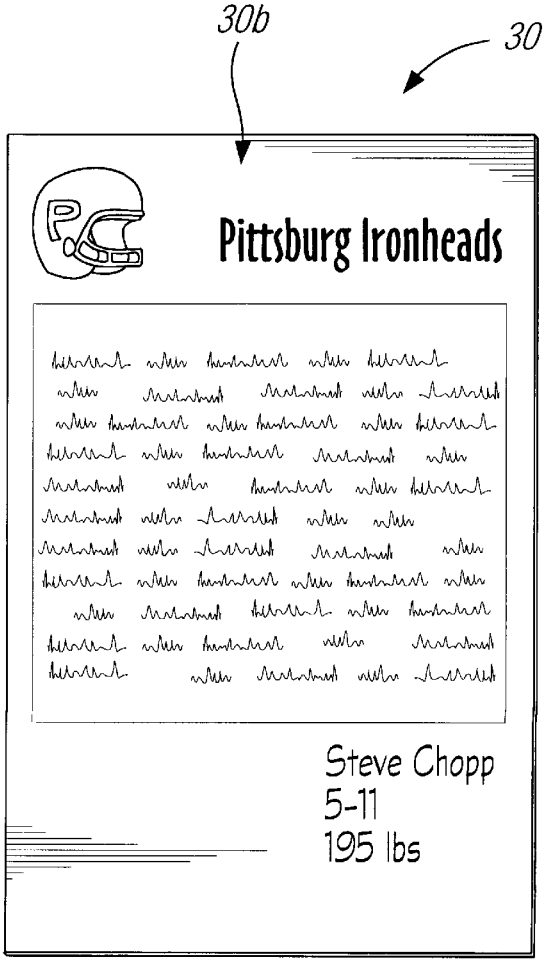
FIG. 7 is a rear view of the trading card of FIG. 6.

An exemplary football trading card 30 which is manufactured in accordance with the present invention is illustrated in FIGS. 6 and 7. FIG. 6 illustrates a front side 30*a* of the card 30 which has a textured image and an ink image formed thereon in the manner described above with reference to FIG. 1. FIG. 7 illustrates the rear side 30*b* of the card 30 which additionally has an ink image printed thereon as described with reference to FIG. 2.

The front side 30*a* of the card 30 includes a picture of a football player 32 named Steve Chopp, whereas Steve's biographical data and statistics are printed on the rear side 30*b* of the card 30. As viewed in FIG. 6, the player 32 is wearing a uniform 34 and a helmet 36, and holding a football 38. Further visible is sky 40 and grass 42.

A first textured pattern of raised circular protrusions or bumps is preferably formed in the image area of the football 38, whereas a continuous line is provided to accentuate the seams of the football 38. Continuous linear ink protrusions of the first textured pattern are also formed to accentuate items such as portions 34*a* and 34*b* of the uniform 34 and shoelaces 34*c* as viewed in FIG. 6. The portions of the printed image in these areas are preferably made at least partially transparent so that light will be reflected back therethrough from the reflective layer. Thus, the helmet 36 and football 38 will have a shiny appearance to simulate depth, whereas the football 38 and other textured areas will appear embossed to further enhance the simulated depth effect.

The tactile second textured pattern can be provided in, for example, a raised border 44 of the card 30. A larger portion of the second textured pattern including elongated protrusions can be provided, for example, in the area of the grass 42 to provide a textured feeling which simulates actual grass.

In summary, the present invention provides a method for producing a printed or similarly produced article having an image display which overcomes the drawbacks of the prior art, and enables a pseudo three-dimensional visual display comprising textured patterns which simulate depth and also present a tactile textured feeling to the touch to be formed on a surface of a base sheet which can be opaque as well as transparent.

The present invention enables a two-sided article, such as a trading card, poster, decal or sign, to be produced by printing an image on the side of the sheet opposite that which supports the textured patterns. This eliminates the need to laminate two separately printed articles to one another, the method presently used to produce two-sided cards.

Various modifications will become possible for those skilled in the art after receiving the teachings of the present disclosure without departing from the scope thereof. For example, the image layers can be formed using a technique other than ink printing, for example painting by hand.

I claim:

1. An image display, comprising:

a base having a front surface;

a reflective layer formed over the front surface;

an image formed over the reflective layer;

a first textured pattern formed over the image;

a transparent layer formed over the first textured pattern; and a second textured pattern formed over the transparent layer.

2. A display as in claim 1, in which the image is formed over only a portion of the front surface.

3. A display as in claim 2, in which the first textured pattern is also formed over a portion of the front surface external of the image.

4. A display as in claim 2, in which the second textured pattern is also formed over a portion of the front surface external of the image.

5. A display as in claim 1, in which the reflective layer is substantially opaque.

6. A display as in claim 1, in which the reflective layer is at least partially transparent.

7. A display as in claim 1, in which the reflective layer is holographic.

8. A display as in claim 1, in which the reflective layer is diffractive.

9. A display as in claim 1, in which the image is at least partially transparent.

10. A display as in claim 1, in which the image comprises a substantially opaque portion and an at least partially transparent portion.

11. A display as in claim 1, in which the image is formed of ink.

12. A display as in claim 1, in which the first textured pattern is formed of ink.

13. A display as in claim 1, in which the second textured pattern is formed of ink.

14. A display as in claim 1, in which the first textured pattern is formed by embossing.

15. A display as in claim 1, in which the first textured pattern is convex.

16. A display as in claim 1, in which the first textured pattern is concave.

17. A display as in claim 1, in which the second textured pattern is formed by embossing.

18. A display as in claim 1, in which the second textured pattern is convex.

19. A display as in claim 1, in which the second textured pattern is concave.

20. A display as in claim 1, in which the base is substantially opaque.

21. A display as in claim 1, in which the base is at least partially transparent.

22. A display as in claim 1, in which:

the base has a rear surface; and the display further comprises an additional image formed over the rear surface.

23. A display as in claim 22, further comprising an additional transparent layer formed over the additional image.

24. A method of forming an image display, comprising the steps of:

(a) providing a base having a front surface;

(b) forming a reflective layer over the front surface;

(c) forming an image over the reflective layer;

(d) forming a first textured pattern over the image;

(e) forming a transparent layer over the first textured pattern; and (f) forming a second textured pattern over the transparent layer.

25. A method as in claim 24, in which step (c) comprises forming the image over only a portion of the front surface.

26. A method as in claim 25, in which step (d) comprises also forming the first textured pattern over a portion of the front surface external of the image.

27. A method as in claim 25, in which step (f) comprises also forming the second textured pattern over a portion of the front surface external of the image.

28. A method as in claim 24 in which step (f) comprises forming the second textured pattern over at least a portion of the first textured pattern.

29. A method as in claim 24, in which step (b) comprises forming the reflective layer of a substantially opaque material.

30. A method as in claim 24, in which step (b) comprises forming the reflective layer of an at least partially transparent material.

31. A method as in claim 24, in which step (b) comprises forming the reflective layer of a holographic material.

32. A method as in claim 24, in which step (b) comprises forming the reflective layer of a diffractive material.

33. A method as in claim 24, in which step (c) comprises forming the image of an at least partially transparent material.

34. A method as in claim 24, in which step (c) comprises forming the image to comprise a substantially opaque portion and an at least partially transparent portion.

35. A method as in claim 24, in which step (c) comprises forming the image of ink.

36. A method as in claim 24, in which step (d) comprises forming the first textured pattern of ink.

37. A method as in claim 24, in which step (f) comprises forming the second textured pattern of ink.

38. A method as in claim 24, in which step (d) comprises forming the first textured pattern by embossing.

39. A method as in claim 24, in which step (d) comprises forming the first textured pattern to be convex.

40. A method as in claim 24, in which step (d) comprises forming the first textured pattern to be concave.

41. A method as in claim 24, in which step (f) comprises forming the second textured pattern embossing.

42. A method as in claim 24, in which step (f) comprises forming the second textured pattern to be convex.

43. A method as in claim 24, in which step (f) comprises forming the second textured pattern to be concave.

44. A method as in claim 24, in which step (a) comprises providing the base as being substantially opaque.

45. A method as in claim 24, in which step (a) comprises providing the base as being at least partially transparent.

46. A method as in claim 24, in which:

step (a) comprises providing the base as having a rear surface; and the method further comprises the step of:

(g) forming an additional image over the rear surface.

47. A method as in claim 46, further comprising the step of:

(h) forming an additional transparent layer over the additional image.

* * * * *